US010070232B2

(12) United States Patent
Sø et al.

(10) Patent No.: US 10,070,232 B2
(45) Date of Patent: Sep. 4, 2018

(54) ANTENNA UNIT

(71) Applicant: Oticon A/S, Smørum (DK)

(72) Inventors: Rune Sø, Smørum (DK); Jens Troelsen, Smørum (DK)

(73) Assignee: Oticon A/S, Smørum (DK)

( * ) Notice: Subject to any disclaimer, the term of this patent is extended or adjusted under 35 U.S.C. 154(b) by 48 days.

(21) Appl. No.: 14/959,978

(22) Filed: Dec. 4, 2015

(65) Prior Publication Data

US 2016/0165366 A1 Jun. 9, 2016

(30) Foreign Application Priority Data

Dec. 5, 2014 (EP) ..... 14196563

(51) Int. Cl.
*H04R 25/00* (2006.01)

(52) U.S. Cl.
CPC ..... *H04R 25/554* (2013.01); *H04R 25/65* (2013.01); *H04R 2225/51* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,699,733 | B2 * | 4/2014 | Polinske | H01Q 1/243 381/312 |
| 2009/0196449 | A1 * | 8/2009 | Platz | H01Q 1/085 381/330 |
| 2012/0093324 | A1 | 4/2012 | Sinasi | |
| 2013/0342407 | A1 | 12/2013 | Kvist et al. | |
| 2013/0343586 | A1 * | 12/2013 | Kvist | H04R 25/554 381/315 |
| 2014/0010394 | A1 | 1/2014 | Kvist | |
| 2014/0321685 | A1 | 10/2014 | Rabel | |
| 2016/0183016 | A1 * | 6/2016 | So | H01Q 1/273 381/315 |

FOREIGN PATENT DOCUMENTS

| | | | |
|---|---|---|---|
| EP | 2723101 | A2 | 4/2014 |
| EP | 2 733 962 | A1 | 5/2014 |

* cited by examiner

*Primary Examiner* — Amir Etesam
(74) *Attorney, Agent, or Firm* — Birch, Stewart, Kolasch & Birch, LLP

(57) ABSTRACT

A hearing device for augmenting the hearing of a user. The hearing device comprises an antenna unit having a slot is disclosed.

21 Claims, 3 Drawing Sheets

ANTENNA UNIT

FIELD

The present disclosure is concerned with hearing device antenna units. The present disclosure is further concerned with hearing devices having an antenna unit or several antenna units.

BACKGROUND

Devices placed at the ear for e.g. assisting a person having a hearing loss and for compensating for that hearing loss, or for any other reason providing an enhanced listening experience, may advantageously receive and/or transmit signals to other units wirelessly. For establishing wireless communication, an antenna unit is needed.

SUMMARY

It is an intension that the antenna units described in the present disclosure may provide improved wireless communication. Further, the present disclosure may at least provide alternative solutions compared to prior art.

In one aspect a hearing device having a housing to be worn at an ear of a person is disclosed with one or more of the below mentioned features. The hearing device is configured to be worn at an ear of a person, and the hearing device comprises an antenna unit. The antenna unit may be used for establishing wireless communication with other units. The antenna unit may comprise a first part and a second part forming a radiating structure. The first part of the radiating structure may have a first perimeter part, and the second part of the radiating structure may have a second perimeter part. The first perimeter part and the second perimeter part may be arranged so as to define part of a slot. The slot may define a slot plane where the electrical field component of the emitted electromagnetic field at the slot is parallel to the slot plane. When the antenna unit is arranged in the hearing device, the slot may be advantageously be formed at or near a corner or edge of the top of the housing of the hearing device; this may allow a good utilization of the space in the housing and bring the slot away from the lossy material in the head. The slot may be open at one end or closed. The hearing device may comprise a fed for feeding the antenna unit with an electrical signal. The electrical signal may be modulated in any suitable way. The electrical signal may represent data in a digital representation or analog representation. Data communicated via the antenna may represent audio, control information, operation programs, settings or any other type of data.

The first and the second parts are preferably provided as plane surfaces, as these are the easiest to arrange in a housing to be worn at an ear of a person and/or because these flat shapes are easy to manufacture. Alternatively, the first and/or second part may include a protrusion, either smooth or discontinuous, which may for instance fit into a recess in the housing. The first and second parts are preferably provided as sheets or coatings on a substrate. In the antenna unit, at least when arranged in a housing, the first part and the second parts may be arranged so that the first part and the second part either are displaced relative to each other, or that an angle between them, e.g. between the surface normal of the parts, wherein the angle is different from zero. Preferably, the first part and/or the second part is flat, or substantially flat, meaning that any three points not in a line on the respective part could be used to define or characterize a plane in the part.

The antenna unit is preferably adapted to emit and/or receive electromagnetic signals at radio frequencies. The antenna unit may be adapted to emit and/or receive electromagnetic signals in the ISM band. Radio frequencies may be in the range from 50 MHz to 15 GHz, such as 150 MHz to 750 MHz, such as 1 to 6 GHz, such as around 2.4 GHz, such as around 5 GHz.

Antennas for transmission of RF electromagnetic signals are preferably designed to have an electrical size of at least one quarter of the wavelength of the transmitted signal, since this generally allows high antenna efficiency and wide bandwidth. However, many apparatuses do not have room for an antenna large enough to satisfy this condition. For an RF signal with a frequency of e.g. 100 MHz, one quarter of the wavelength equals 0.75 m. It is thus common to utilize antennas that are physically considerably smaller than one quarter of the wavelength. Such antennas are generally referred to as "electrically short" or "electrically small" antennas. The antenna unit may be an electrically short or electrically small antenna.

Generally, at a given link performance, i.e. a given data rate and encoding, a higher quality link allow a lower power consumption of both the transmitter and receiver.

The antenna unit according to the present disclosure may be used for establishing a wireless link between two hearing devices in which information is wirelessly communicated between hearing devices and/or between a wireless accessory device and a hearing device. Portable, and especially wearable, units usually have limited operation time limited by the amount of power available from relatively small batteries, and thus lowering power consumption to extend battery life is a major issue for such devices. Further, hearing aid to be worn at or in the ear of a user should be as inconspicuous as possible, meaning that compactness of the housing is important. This is at least partly due to the stigmatization that is often attached to hearing loss.

The antenna unit as presented in the present disclosure may be used in a hearing aid. The hearing aid may comprise an audio converter for reception of an acoustic signal and conversion of the received acoustic signal into a corresponding electrical audio signal. Alternatively, the hearing aid may be configured to receive a signal representing sound via an external device, such as an external microphone, a mobile phone or other suitable source. The hearing aid may comprise a signal processor, and related memory, for processing the electrical audio signal into a processed audio signal to compensate for a specific hearing loss of the user of the hearing aid. The hearing aid may comprise a transducer connected to an output of the signal processor for converting the processed audio signal into an output signal. The hearing aid may comprise a transceiver for wireless data communication, wherein the transceiver is connected to the antenna unit adapted for electromagnetic field emission and/or electromagnetic field reception. These components in the hearing aid may be exchanged or supplemented with other components, devices and/or units having one or more additional functions.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 2:
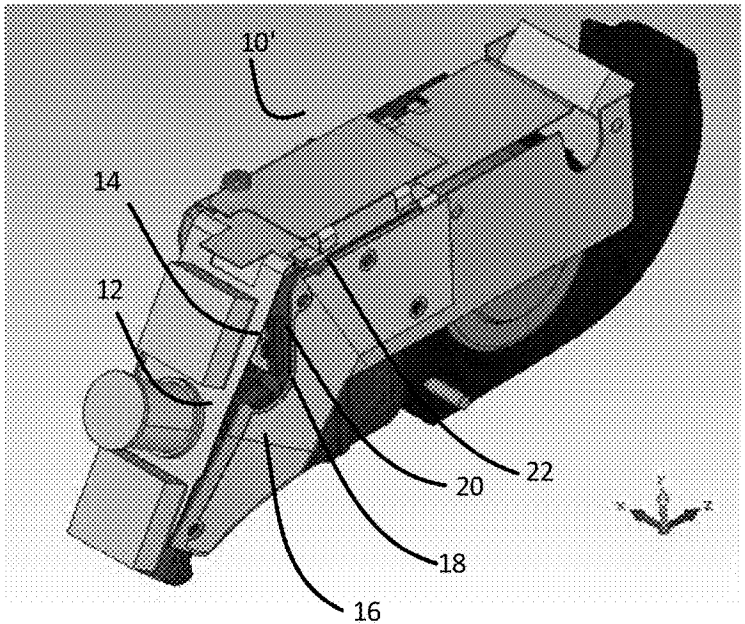
FIG. 2 schematically illustrates a hearing device having a forward slot antenna unit.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus are described using various blocks, functional units, modules, components, circuits, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure.

The hearing device may be a hearing aid that is adapted to improve or augment the hearing capability of a user by receiving an acoustic signal from a user's surroundings, generating a corresponding signal perceivable by the user as sound, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Figure 1:
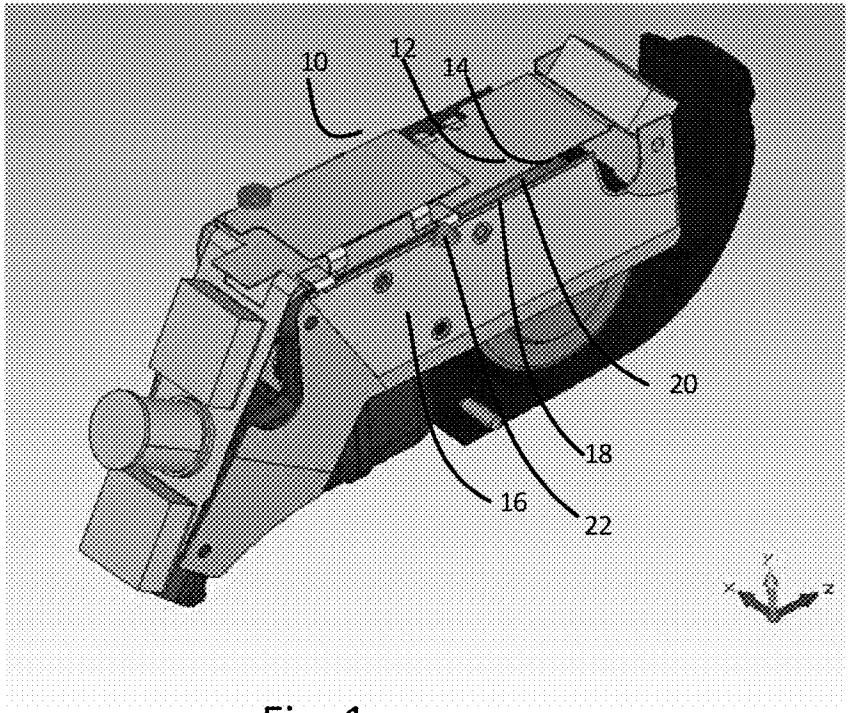
FIG. 1 schematically illustrates a hearing device having a backward slot antenna unit.

Now referring to FIG. 1 that schematically illustrates an antenna unit 10 mounted on various components making up at least part of the sound processing part of a hearing device. FIG. 2 schematically illustrates an antenna unit 10' similar to the one in FIG. 1, with a slight difference. These two figures illustrate that the part 16 of the antenna unit 10, 10' located on the side of the hearing device may be positioned more to one or the other end of the hearing device.

The antenna configuration illustrated in FIG. 1 could be termed a backward pointing slot, as the end where the battery 22 is placed would be the part facing backwards relative to the face of the user when the hearing device is placed at the ear. The configuration in FIG. 2 could be termed a forward pointing slot, as this is the end where the hook would be placed, the hook being the part of the housing gripping the pinna to ensure the hearing device stay in place during use.

The assemblies in both figures are to be mounted in a housing to protect the antenna units from the surrounding environment and to provide a pleasing look to the user while improving wearing comfort.

The antenna units 10 and 10' comprises a first electrically conductive material 12 having a first perimeter part 14. The antenna unit 10 further comprises a second electrically conductive material 16 having a second perimeter part 18. The first perimeter part 14 and the second perimeter part 18 are arranged so as to define a slot 20.

The slot 20 in FIG. 1 extends along, or parallel to, a longitudinal axis of the hearing device 10. Here the slot 20 is an open slot. When the slot 20 is fed with an electrical signal, the slot 20 radiates an electromagnetic field. The feed is illustrated as being at 22. The slot 20 defines a slot plane where an electrical field component of the emitted or radiated electromagnetic field is parallel to the slot plane, or at least the major part or the dominant mode, of the radiated electromagnetic field is primarily parallel to the slot plane at the slot plane. In use at a user's head, the electric field component in farfield may be differently oriented for any number of reasons.

The first and the second electrically conductive materials 12 and 16 have plane surfaces, as these are, relatively, easy to arrange in a housing to be worn at an ear of a person. More importantly, these flat shapes are easy to manufacture. Alternatively, one of, or both, the electrically conductive materials 12 or 16 may include protrusions, either smooth or discontinuous, which may, for instance, be shaped to fit into a recess in the housing or to accommodate a part of some electronic components.

The first and/or second electrically conductive materials 12 and/or 16 are preferably provided as sheets or coatings on a substrate. Preferably, the first and second parts are flat, or substantially flat. The first and/or second part may include bends.

The antenna units 10 and 10' of FIGS. 1 and 2 are contemplated to improve wireless communication between similar, or identical, units, placed at either side of the head of a user, i.e. in a binaural hearing system. These antenna units then optimize binaural performance, i.e. ensuring the best transfer of signals between two devices placed at opposite sides of the head of a user, providing improved bandwidth and/or signal to noise ratio for the transmission.

The antenna unit 10 and 10' may be used at a desired frequency, and for use with e.g. the Bluetooth or Bluetooth low energy standard, where the operational frequency is around 2.4 GHz or around 5 GHz. Other data protocols may be used. Other proprietary protocols may be used.

FIGS. 3-9 schematically illustrates cross-sections of two electrically conductive materials, throughout the figures denoted 30 and 32, arranged with an angle, which is denoted alpha ($\alpha$). These illustrations show some of the different possible arrangements of two conductive parts 30 and 32 forming the radiating part of the antenna unit. The antenna unit may be supplemented by adding more parts or other arrangements. The antenna unit may constitute a diversity antenna or be part of a larger antenna system providing communication at multiple frequencies.

In FIGS. 3-9 the angle is shown as the smallest angle between the two normal of the two surfaces. The angle could also be defined as the angle between the normal pointing outwards from the antenna structure. In the present description, the term outward is here to be understood as the surface part of the antenna unit facing the inner part of the outer shell/housing of a hearing device.

Figure 4:
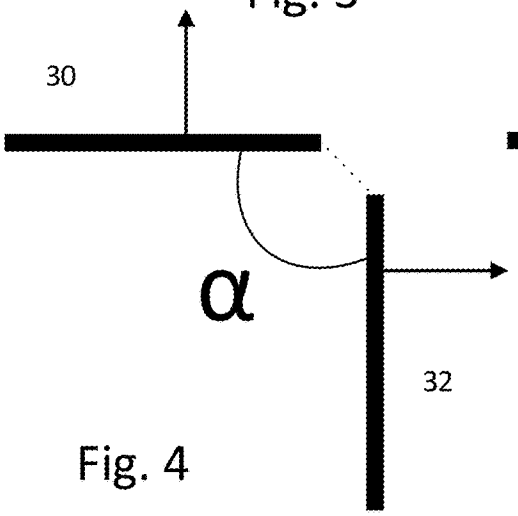
Figure 5:
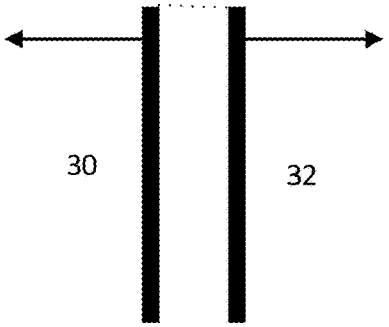
Figure 6:
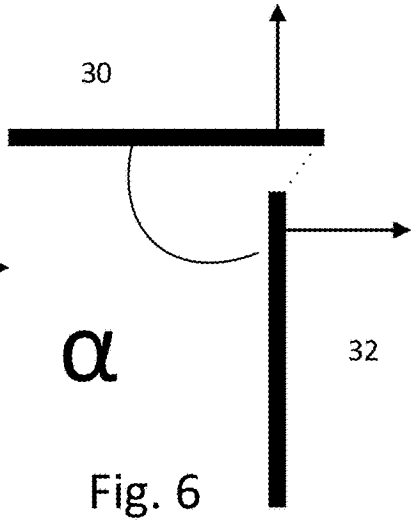
Figure 7:
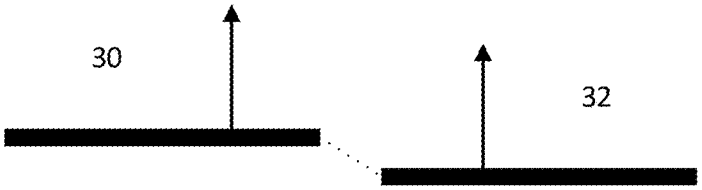
Figure 8:
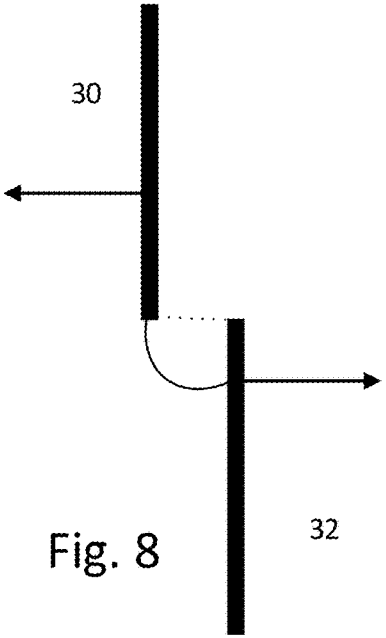

In FIGS. 3 to 9, the angle $\alpha$ in the illustrated configurations is in the interval 0 to 90 degrees. In general, the angle could be any suitable angle, such as around 45 degrees, such as around 90 degrees, such as below 90 degrees, such as above zero degrees, such as around 85 degrees, such as precisely 90 degrees. Especially the angle should be different from zero, i.e. the normal and the ear-to-ear axis should not be parallel when the hearing device is worn in its operational position at an ear of a wearer. The two parts could be arranged so that one surface is tilted relative to the other, e.g. they could be arranged so that one part is perpendicular to the other, in that way the angle between them, or more specifically between the surface normal, will be 90 degrees. The mathematical extension of the parts would define an intersection line, but in order to establish the slot, the two parts are not in physical contact, at least in the area between the first and second perimeter parts. As illustrated in FIGS. 4 and 6, an angle of 90 degrees may advantageously be combined with an offset distance. In FIGS. 5 and 8 the angle is 0 or 180 degrees, depending on which side the normal is defined. Advantageously the slot is defined at an edge of the antenna device 10, 10', as opposed to on the side facing away from the head of the user when in use.

FIG. 7 further illustrates that the first part 30 and the second part 32 are displaced relative to each other in a direction parallel to the surface normal. In FIG. 7 the angle $\alpha$ is zero.

Figure 9:
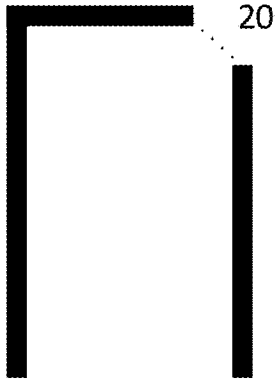
FIGS. 9 and 11 schematically illustrates different placements of a slot seen in a cross-sectional view, FIG. 10 schematically illustrates a hearing aid placed on an ear of a user, FIGS. 12-14 schematically illustrates different slot geometries, and FIG. 15 schematically illustrate a slot having a growing slot.
Figure 11:
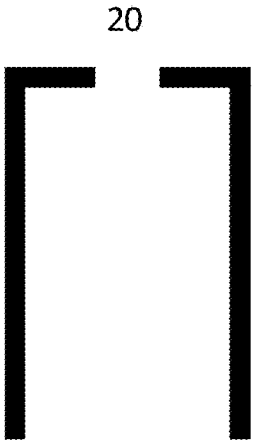

The two surfaces, schematically illustrated in FIGS. 5, 7, 8 as 30 and 32, may be arranged so that the surface normal of the two parts are parallel, but the parts 30, 32 should then be displaced or offset by a distance. This distance could be e.g. around ½ of the intended operational wavelength, or any other distance, such as ¼ wavelength, such as ⅛ wavelength, such as 1/16 wavelength, such as 1/32 wavelength, such as 1/64 wavelength or any other suitable length measured in mm or measured in the intended operational wavelength. This allows orienting the slot to an optimal position relative to the head of the person. This optimal position could for instance be orienting the slot 20 as illustrated in FIG. 9.

Generally, the antenna unit could be arranged in the housing so that when the housing is worn at the ear of the user, the normal to the slot plane has a direction or angle in the interval 0 to 90 degrees relative to an ear-to-ear axis of the user, such as above 0 degrees and/or below 90 degrees. The angle between the normal to the slot plane and the ear-to-ear axis could be in the interval 10 to 80 degrees, such as in the interval 20 to 80 degrees, such as in the interval 30 to 70 degrees, such as in the interval 40 to 60 degrees, such as 0 degrees, such as 45 degrees, such as 90 degrees.

When the antenna unit 10, 10' is in the intended position in a wearable device, and the wearable device is worn on the head of a person, then the normal of the slot plane has an angle in the interval 0 to 90 degrees relative to an ear-to-ear axis of the user. This provides the possibility to orientate the slot to an optimal position relative to the head of the person, e.g. when a certain shape of the housing is given it is then possible to place the parts so that the slot plane is orientated in a desired manner. Placing the slot plane consciously relative to the head allow suitable optimization of binaural communication, i.e. for ensuring the best transfer of signals between two devices placed at opposite sides of the head of a person.

The first perimeter part and the second perimeter part may be arranged so that the geometric minimum distance, i.e. the shortest distance at any point along the first or second perimeter part, between them is substantially constant along the length of the slot. At some sections of the perimeters, this distance may, however, be varied. A constant distance is for instance schematically illustrated in FIG. 12, the distance is determined as indicated by the punctured line 40. In such a case it is desirable that the first and second perimeter parts have equal lengths, or at least ends at a point where the distance between the end point of the first perimeter part and the end point of the second perimeter part is equal to the minimum distance between the two at e.g. the midpoint of the first perimeter part.

Figure 15:
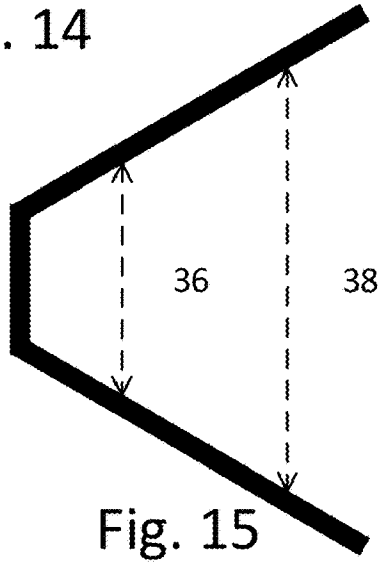

In one form, the geometric distance may be growing from one end along at least a part of the length of the opening so that a wider gap is established. This growth may be linear, logarithmic, exponential or polynomial or a combination hereof so that any suitable geometry may be formed. In FIG. 15 a growing geometrical distance is illustrated, where the distance at 38 is greater than at 36.

It is presently preferred that the geometric minimum distance is substantially constant along the majority of the length of the first or second perimeter part. Generally, if the distance between the two parts are too large the losses will be large and the electromagnetic field will not be confined sufficiently. Preferably, the maximum distance is less than a quarter of the sloth length.

In FIGS. 1 and 2 it is seen that the first electrical conductive material 16, i.e. the part on top of the structure, comprises two parts electrically interconnected and these parts are arranged so as to form a structure having a bend 40 defined at the intersection of the two parts. Here one part is positioned horizontally and the other forms an angle to the first part 16 where at the bend 40 the two parts making up the first part 16 are electrically connected. Due to space constraints in a housing to be worn at an ear of a person, it is advantageous that at least part of the antenna structure includes a bend while maintaining, or even improving, the radiation pattern of the antenna unit in a desired manner.

As illustrated in FIGS. 1 and 2, the first electrically conductive material 16 may be arranged at a top part of the housing, and the second electrically conductive 18 material may be arranged at a side of the housing. In some instances, it is advantageous that one of the first or second electrically conductive materials is arranged at the top part of the housing, and the other part is located at a side of the housing thereby facing towards the pinna or the head when the housing is placed on either the left or right ear.

Generally, the antenna unit 10, 10' with the slot forms a resonant structure when the antenna structure 10, 10' is loaded by the presence of a head and/or the pinna. The antenna unit 10, 10', also forms part of a resonant structure when the housing with the antenna unit is positioned at the head of the user. The resonant frequency of the antenna unit is preferably in the range 50 MHz to 10 GHz, such as in the ISM band at around 2.4 GHz or around 5 GHz. This may be especially advantageous when dealing with the Bluetooth communication protocol. Designing the antenna unit for other suitable frequencies or frequency intervals is also possible.

Figure 14:
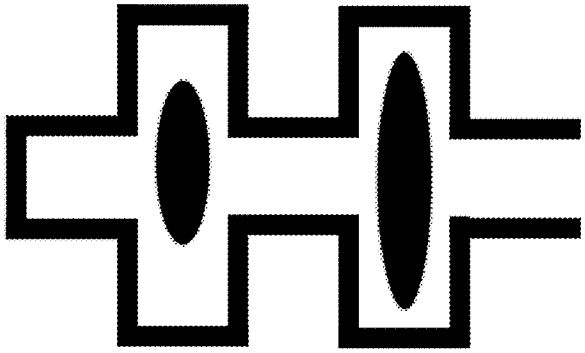
Figure 12:
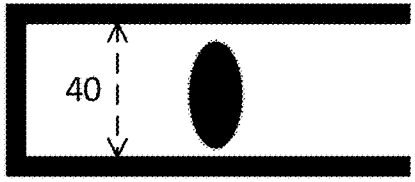
Figure 13:
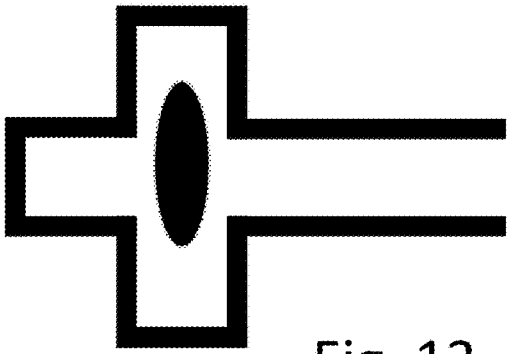

As illustrated in FIGS. 12-14, the slot 20 may be sized to accommodate a battery and/or an audio converter and/or an input device or another type of component. The slot 20 may have a size suitable for receiving components such as batteries or input devices such as push buttons or wheels, or even other electrical or mechanical components. This is contemplated to help save space in the housing, which is a major issue in hearing aids. Further, components may be placed at various positions on the electrically conductive area.

In further implementations, such as illustrated in FIG. 14, the slot 20 may be shaped so that it may accommodate or comprise two or more areas having non-conductive surfaces thereby forming a combined slot. The slot 20 may be formed by a non-conductive area or one or more openings in the substrate.

As further illustrated in the figures, the antenna unit may be formed using one, two or more flex circuit boards. The material for the antenna may be provided on a single flex circuit board, e.g. as a substantially continuous surface with a slot. The outer circumference may be circular, polygonal or any other suitable geometry.

Figure 10:
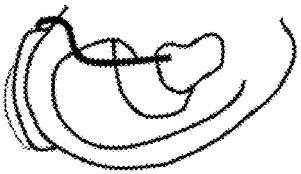
Figure 3:
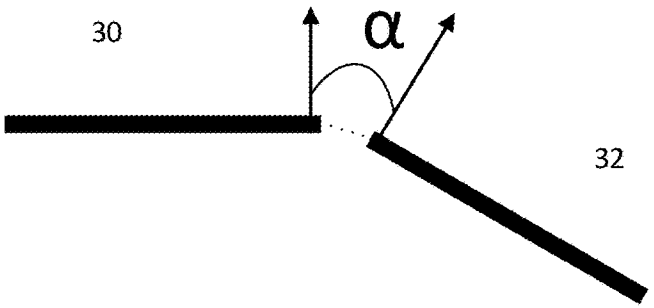
FIGS. 3-8 schematically illustrates different arrangements of parts forming a slot.

FIG. 10 schematically illustrates a hearing device placed on the pinna of a user. In this placement at the top of the pinna, the housing is held in place between the pinna and the skull of the user. In this illustration, the hearing device is of the receiver-in-the-ear-type, where an electrical conductive element transfers a signal to a speaker unit placed in the ear canal, but could alternatively be of a behind-the-ear-type where an air tube leads an acoustic signal generated in the housing to the ear canal via air conduction.

A feed connection 22 is provided to supply the antenna unit with an electrical signal. The feed 22 is preferably a direct feed, but in other embodiments the feed may be a capacitive feed or other suitable feeding method. The feed 22 provides the modulated electrical signal to be transmitted. An antenna feed refers to the component or components of an antenna which feed radio waves to the rest of the antenna structure, or, in receiving antennas, collect the incoming radio waves, convert them to electric currents and transmit them to the receiver. For simplicity, neither feed nor transceiver is illustrated in all the figures.

The antenna unit as disclosed above may be used in a hearing aid comprising an audio converter for reception of an acoustic signal and conversion of the received acoustic signal into a corresponding electrical audio signal, a signal processor for processing the electrical audio signal into a processed audio signal so as to compensate a hearing loss of a user of the hearing aid, a transducer connected to an output of the signal processor for converting the processed audio signal into an output signal, and a transceiver for wireless data communication, wherein the transceiver is connected to the antenna unit adapted for electromagnetic field emission and/or electromagnetic field reception.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

Generally as apparent from the above description, the present disclosure relates to a hearing device having an antenna unit including a slot. Moreover, the present disclosure relates to a hearing device configured to be worn at an ear of a person, the hearing device comprising an antenna unit, the antenna unit comprising a first part and a second part forming a radiating structure, the first part of the radiating structure having a first perimeter part, the second part of the radiating structure having a second perimeter part, and wherein the first perimeter part and the second perimeter part are arranged so as to define part of a slot, the slot defines a slot plane where the electrical field component of the emitted electromagnetic field at the slot is parallel to the slot plane, the hearing device comprising a fed feeding the antenna unit with an electrical signal.

The invention claimed is:

1. Hearing device comprising a hearing device housing configured to be positioned at an ear of a person, and an antenna unit arranged in the housing, the antenna unit including a first plane surface of a first plate having a first perimeter part along an outer circumference of the first plate and a second plane surface of a second plate having a second perimeter part along an outer circumference of the second plate, the first and second perimeter parts of the first and second plates together form a slot antenna, wherein the first plate is physically separate from the second plate;

the first plate and the second plate are arranged such that an angle between a normal pointing outwards from the first plane surface of the first plate and a normal pointing outwards from the second plane surface of the second plate is greater than zero, and the slot is arranged at a corner of the housing.

2. Hearing device comprising a hearing device housing configured to be positioned at an ear of a person, and an antenna unit arranged in the housing, the antenna unit including a first plane surface of a first plate having a first perimeter part along an outer circumference of the first plate and a second plane surface of a second plate having a second perimeter part along an outer circumference of the second plate, the first and second perimeter parts of the first and second plates together form a slot antenna, wherein the first plate is physically separate from the second plate;

the first plate and the second plate are arranged such that an angle between a normal pointing outwards from the first plane surface of the first plate and a normal pointing outwards from the second plane surface of the second plate is greater than zero, and during use the electric field emitted from the slot is perpendicular or near perpendicular to the ear-to-ear axis of the person wearing the hearing device.

3. Hearing device configured to be worn at an ear of a person, the hearing device comprising a hearing device housing configured to be positioned at an ear of a person, and an antenna unit, the antenna unit including a first part and a second part forming a radiating structure, and an antenna feed that feeds the antenna unit with an electrical signal, wherein the first plate of the radiating structure has a first perimeter part along an outer circumference of the first plate, the second plate of the radiating structure has a second perimeter part along an outer circumference of the first plate, the first perimeter part and the second perimeter part are arranged in the housing so as to define part of a slot, the slot defining a slot plane where an electrical field component of an emitted electromagnetic field at the slot is parallel to the slot plane, the first plate is physically separate from the second plate;

the first plate and the second plate are arranged such that an angle between a surface normal pointing outwards from the first plate and a surface normal pointing outwards from the second plate is greater than zero, and the antenna unit is arranged in the housing such that when the housing is worn by a person a normal of the slot plane has a direction in the interval 10 to 90 degrees relative to an ear-to-ear axis of the user.

4. The hearing device according to claim 3, wherein the angle between the surface normal of the first and second plates is 45 degrees or 90 degrees.

5. The hearing device according to claim 3, wherein the first plate has a first plane surface and the second plate has a second plane surface, where the first plane surface and the second plane surface are displaced relative to each other in a direction parallel to the surface normal.

6. The hearing device according to claim 5, wherein when the housing is worn by the person the normal of the slot plane has a direction which is in the interval 30 to 70 degrees, in the interval 40 to 60 degrees, 45 degrees, or 90 degrees.

7. The hearing device according claim 3, wherein the first perimeter part and the second perimeter part are arranged so that the geometric minimum distance between them is substantially constant along the length of the slot.

8. The hearing device according to claim 3, wherein the first perimeter part and the second perimeter part are straight lines and the first perimeter part and the second perimeter part are arranged so that the lines are parallel.

9. The hearing device according to claim 3, wherein the first plate has a first electrically conductive material provided as a sheet on a substrate, the second plate has a second electrically conductive material provided as a sheet on a substrate, and the first electrical conductive material comprises two parts electrically interconnected and the parts are arranged so as to form a structure having a bend defined at the intersection of the two parts.

10. The hearing device according to claim 3, wherein the first plate has a first electrically conductive material provided as a sheet on a substrate, the second plate has a second electrically conductive material provided as a sheet on a substrate, and the first electrically conductive material when used in the housing is arranged at a top part of the housing, and the second electrically conductive material is arranged at a side of the housing.

11. The hearing device according to claim 3, wherein the antenna unit with the slot forms a resonant structure when the antenna unit is loaded by the presence of a head or in free space.

12. The hearing device according to claim 3, wherein the slot comprises an opening configured to receive a battery and/or an audio converter and/or an input device.

13. The hearing device according to claim 3, wherein the slot comprises two or more areas having non-conductive surfaces forming a combined slot.

14. The hearing device according to claim 3, wherein the antenna unit is formed on or by one or more flex circuit boards and the slot is formed by one or more areas of electrically non-conductive material surrounded by electrically conductive material.

15. The hearing device according to claim 3 wherein the hearing device further comprises:

an audio converter for reception of an acoustic signal and conversion of the received acoustic signal into a corresponding electrical audio signal, a signal processor for processing the electrical audio signal into a processed audio signal so as to compensate a hearing loss of a user of the hearing aid, a transducer connected to an output of the signal processor for converting the processed audio signal into an output signal, and a transceiver for wireless data communication, wherein the transceiver is connected to the antenna unit adapted for electromagnetic field emission and/or electromagnetic field reception, and the housing is configured to be positioned behind the ear of the user.

16. The hearing device according to claim 3, wherein at least electronic components of the hearing device is arranged within a space defined at least partly by the radiating structure.

17. The hearing device according to claim 3, wherein the antenna unit is configured to have an operation frequency in the range of 1 to 10 GHz, such as around 2.4 GHz, such as around 5.2 GHz.

18. Use of a hearing device according to claim 1 for communicating with a hand held device.

19. Use according to claim 18, wherein the hand held device is a mobile phone, and a voice signal from the mobile phone is presented to the user via the hearing device.

20. The hearing device according to claim 1, wherein the slot extends along, or parallel to, a longitudinal axis of the hearing device.

21. The hearing device according to claim 2, wherein the slot is open ended.

* * * * *